United States Patent [19]

Tatai et al.

[11] Patent Number: 4,852,713

[45] Date of Patent: Aug. 1, 1989

[54] ESCALATOR HAND-RAIL MADE OF ELASTIC MATERIAL

[75] Inventors: Llona Tatai; Gusztáv Gündisch; László Palotás; Gyula Subotics, all of Budapest, Hungary

[73] Assignee: Taurus Gumiipari Vallalat, Hungary

[21] Appl. No.: 55,076

[22] Filed: May 28, 1987

[51] Int. Cl.[4] ..... B66B 23/00

[52] U.S. Cl. ..... 198/337

[58] Field of Search ..... 198/335, 337; 474/218, 474/253–256

[56] References Cited

U.S. PATENT DOCUMENTS

| | | | |
|---|---|---|---|
| 2,578,566 | 12/1951 | Masek et al. | 198/16 |
| 2,578,567 | 12/1951 | Masek et al. | 198/16 |
| 2,766,868 | 10/1956 | Tilton | 198/337 |
| 2,956,662 | 10/1960 | Hansen | 198/337 |
| 3,633,725 | 1/1972 | Smith | 198/337 |
| 3,719,265 | 3/1973 | Barry et al. | 198/16 R |
| 3,740,799 | 6/1973 | Earle . | |
| 3,839,766 | 10/1974 | Kenney | 474/254 X |
| 3,949,858 | 4/1976 | Ballocci et al. | 198/337 |
| 3,988,940 | 11/1976 | Szonn et al. | 474/254 |
| 4,051,741 | 10/1977 | Marczewsky | 474/256 |
| 4,336,021 | 6/1982 | Haines | 474/256 |
| 4,618,387 | 10/1986 | Fisher et al. | 198/337 X |
| 4,637,810 | 1/1987 | Beck | 474/253 |
| 4,650,446 | 3/1987 | Pinto et al. | 474/253 |

FOREIGN PATENT DOCUMENTS

| | | | |
|---|---|---|---|
| 898726 | 4/1972 | Canada | 198/335 |
| 1773183 | 7/1958 | Fed. Rep. of Germany . | |
| 1101717 | 9/1961 | Fed. Rep. of Germany . | |
| 1756354 | 4/1970 | Fed. Rep. of Germany | 198/335 |
| 2000266 | 7/1971 | Fed. Rep. of Germany | 198/337 |
| 2060356 | 6/1972 | Fed. Rep. of Germany . | |
| 2142098 | 3/1973 | Fed. Rep. of Germany | 198/337 |
| 2203179 | 8/1973 | Fed. Rep. of Germany | 198/337 |
| 1345321 | 7/1974 | Fed. Rep. of Germany . | |
| 2302602 | 7/1974 | Fed. Rep. of Germany . | |
| 3208916 | 9/1983 | Fed. Rep. of Germany . | |
| 1340585 | 9/1963 | France . | |
| 1419483 | 10/1965 | France . | |
| 2401184 | 3/1979 | France . | |
| 0020850 | 2/1981 | Japan | 474/254 |
| 1163112 | 9/1969 | United Kingdom . | |

*Primary Examiner*—Frank E. Werner
*Assistant Examiner*—D. Glenn Dayoan
*Attorney, Agent, or Firm*—Handal & Morofsky

[57] ABSTRACT

A reinforced "C" shaped hand-rail for use with escalators, moving pavements and the likes made of elastic material. The invented hand-rail is injection moulded from polyurethane, foamed polyurethane or other synthetic material possessing similar physical characteristics, so that at least one of its outside and inside is lamellated, the external or internal surface of the side opposite the lamellated surface is wavy conforming to the lamellae. The hand-rail is provided with reinforcing steel wire insert (1).

7 Claims, 3 Drawing Sheets

ESCALATOR HAND-RAIL MADE OF ELASTIC MATERIAL

FIELD AND BACKGROUND OF THE INVENTION

The invention relates to reinforced "C"-shaped hand-rail made of plastic material for use with escalators and moving pavements and the like.

As known, the presently used escalator hand-rails are made of rubber, into which textile-, in given case metal-insert, or steel band, or their various combinations are built in as reinforcement.

Thus for example the rubber hand-rail of the escalator according to the West-German patent specification No. 1 101 717 is provided with a vulcanized steel band of suitable length for clamping the teeth of the driving wheel and to be driven synchronously with the escalator strap.

The moving hand-rail according to the West-German patent specification No. 860 701 contains a metal insert to prevent the elongation. This insert is a perforated endless steel band running parallel with the shaft of the driving wheels along the length of the hand-rail.

An escalator hand-rail with a coloured cover is described in the English patent specification No. 1 163 112, reinforced with a layer of cord fabric to eliminate the elongation.

According to the French patent specification No. 1 419 483 glass cloth inserts are built into the rubber material of the escalator hand-rail to prevent elongation and to take up the tensile load. At least the warp of the textile has to be made of fibreglass. Since the glass cloth has poor adhesive characteristics, the adhesion, specially at blind splicing, is facilitated with traditional rubberized textile-layers between the glass cloths.

Finally the escalator hand-rail according to the French patent specification No. 1 340 585 differs from the traditional solutions in that its visible surface is provided with indentations, knurls, letters, or figures for easier noticeability.

The sliding surface of the hand-rail is generally made of textile according to the known solutions.

The common drawback of the known escalator hand-rails is that they can be no longer repaired, when the textile sliding layer is worn down, furthermore, owing to the construction of the hand-rails, the position of the neutral layer is asymmetrical, consequently the sliding ends of the "C" profile are exposed to complex dynamic loads. This expedites the fatigue of the system, and thereby separation of the textile layers.

Construction of the hand-rail with textile insert is extremely labour-intensive, and requires precise preparatory activities.

For reducing the elongation of the escalator hand-rails, the constructions comprising the combination of textile and steel wire have been generally used further complicating the production process of escalator hand-rail.

The blind splicing of the systems used according to the present practice requires similarly labourintensive stepping or buffing bruising activities. The layers of raw rubber mixture between the stepped ends are vulcanized together in splicing press on the site of the assembly. Since the continuity of the reinforcing layers in the ends of the vulcanized rubber hand-rail stops, these spots represent weak points compared to the other parts of the hand-rail.

SUMMARY AND OBJECTS OF THE INVENTION

The invention is aimed to permit the elimination of the above drawbacks.

The invention is based on the recognition, that with the use of material possessing suitable physical characteristics and with a suitable special form the aim set can be achieved.

The above aim can be achieved by providing a hand-rail defined in claim 1. Further preferred embodiments are defined in dependent claims.

According to the invention an escalator hand-rail injection moulded from polyurethane provided with steel wire insert was constructed. Instead of polyurethane, foamed polyurethane or other synthetic materials with similar physical characteristics can be used. The invented escalator hand-rail—similarly to the known solutions—is shaped as a "C" profile, the sides of which—either inside or outside or both—are laminated. Owing to the lamination, the neutral zone in respect of strength (including the bending) is situated in the immediate vicinity of the steel wires.

By neutral zone is meant a zone of the hand-rail which is free of compressive and tractive stresses while passing through a curved part of its path.

A flexible character of the excalator hand-rail formed according to the invention is achieved through the lamellation of the "C" profile. The lamellated parts are followed by the wave profile of the outer surface. This way thin walled arches are formed, allowing the formation of a smaller arc upon the elastic compression when the hand-rail is rolling down, and thus the compressive stresses become transformed to bending stresses. This way the life expectancy of the product can be considerably extended.

The lamellated surface is formed by providing indentations arranged in a distance from each other. On the opposite surfaces there are vaults formed therein, and the vault together with the indentation form arched segments contoured by concentric circles; the angle between the sections connecting the points of contact of the radii of the convex and concave surfaces and with the centre of the circles pertaining to the arcs of the lamellae and the indentations is minimum 45°.

A further essential advantage and characteristic feature of the solution according to the invention is that the ends of the moving hand-rail are provided with metal joint fixed to the reinforcing steel wire. This way moving hand-rails of different length can be jointed continuously with metal joints. The invented moving hand-rails can be made of elements in such length, that any required length can be realised.

According to a feasible solution, the ends of the steel wire threaded into the split hole of the metal joints are clamped with lock pins tightly fitting into the retaining holes. Rolling down of the metal joints along an arched path is accomplished by forming the part bearing against the arched section of the path at the place of turnover to have a radius R. The metal joints are fixed to each other for example with screws.

BRIEF DESCRIPTION OF THE DRAWINGS

The invention is described in detail on the basis of preferred embodiments and with reference to the drawing in which:

FIGS. 1 and 2 illustrate the axonometric view of two different embodiments of an escalator hand-rail according to the invention. The drawings show the steel wires 1 inserted during injection moulding into the hand-rail, The steel wires can be embedded in a strap 17 made of polyurethane or other synthetic material. This solution particularly advantageous due to the feature that by adjusting the physical parameters of the material of the belt portion the sliding friction and abrasion parameters as well as the dynamic parameters of the hand-rail can also be advantageously influenced.

Desired rigidity of the "C" profile is accomplished by increasing the Shore hardness by adjusting 90°-95° Sh. This solution makes the use of other built in inserts unnecessary, at the same time it provides favourable conditions for the loads by the suitable construction and physical characteristics.

Figure 1:
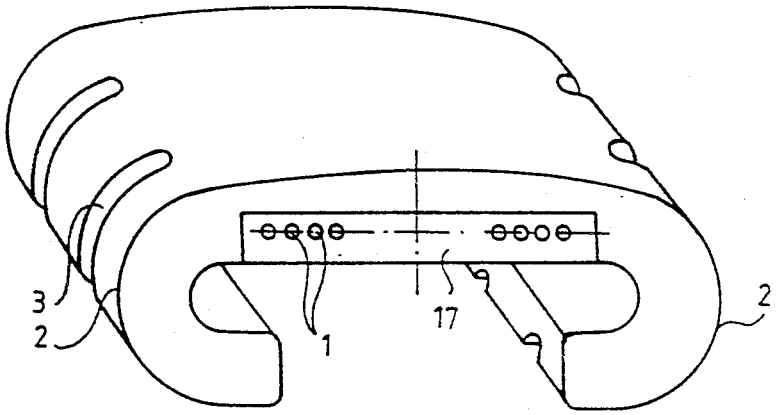
FIG. 1; shows an axonometric sectional view of an embodiment of the invention.
Figure 2:
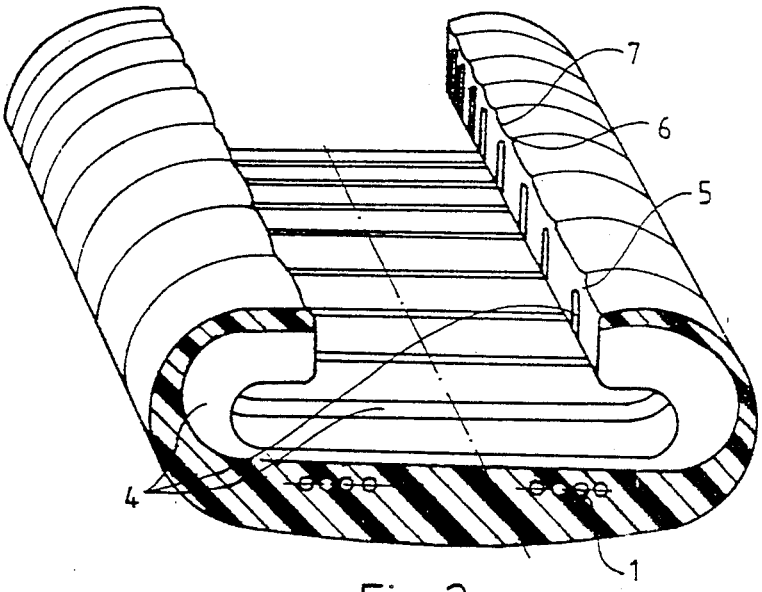
FIG. 2; axonometric sectional View of another embodiment.

The embodiment shown in FIG. 1 consists of a hand-rail with two side-parts 2 provided with outer indentations 3 on the outer surface of side-parts 2. The embodiment shown in FIG. 2 illustrates a hand-rail with inner indentations 4 extending along the inner surface of the entire "C" profile, and wherein the outer surface of the hand-rail opposite the indentations 4 is formed in a wave-like fashion with convex arches or wave crests 6 and concave arches or wave troughs 7 with the wave crests 6 corresponding to indentations 4 and forming thereby arches 5 (bridges).

Thickness of said arches 5 is minimum 2 mm allowing bending of said arches 5 while the hand-rail rolls down a curved path and shortening of the arch of the side part of the "C" profile situated farther from the neutral zone.

Since the friction coefficient of the surface of polyurethane, especially the polyurethane foam approaches the friction coefficient of the textiles, the textile cover of the sliding surfaces in contact with the metal rails can be dispensed with in case of the solution according to the invention.

The inside of the polyurethane hand-rails—after wear to a certain extent—can be roughened, and a fresh layer of polyurethane foam can be applied onto it by injection moulding, whereby the moving hand-rail is renovated, obviously further extending the life of the product.

Since the moving hand-rails do not contain textile insert, only reinforcing steel wire, it is possible to use metal joints. By using such metal joints, the moving hand-rails can be made endless i.e. spliced with mechanical joint without requiring vulcanization.

The escalator hand-rails can be produced in different lengths as required by the specific place of utilization und built in at the site of utilization. In case of the know solutions, the moving hand-rails are cut to size on the site, and spliced to the required length by vulcanization after various complicated preparatory activities. However, a safe solution considering the strength aspects cannot be ensured with this known method.

In case of the solution according to the invention, the blind splicing with the use of mechanical joints can be realized in a simple way on the site of utilization.

Figure 3:
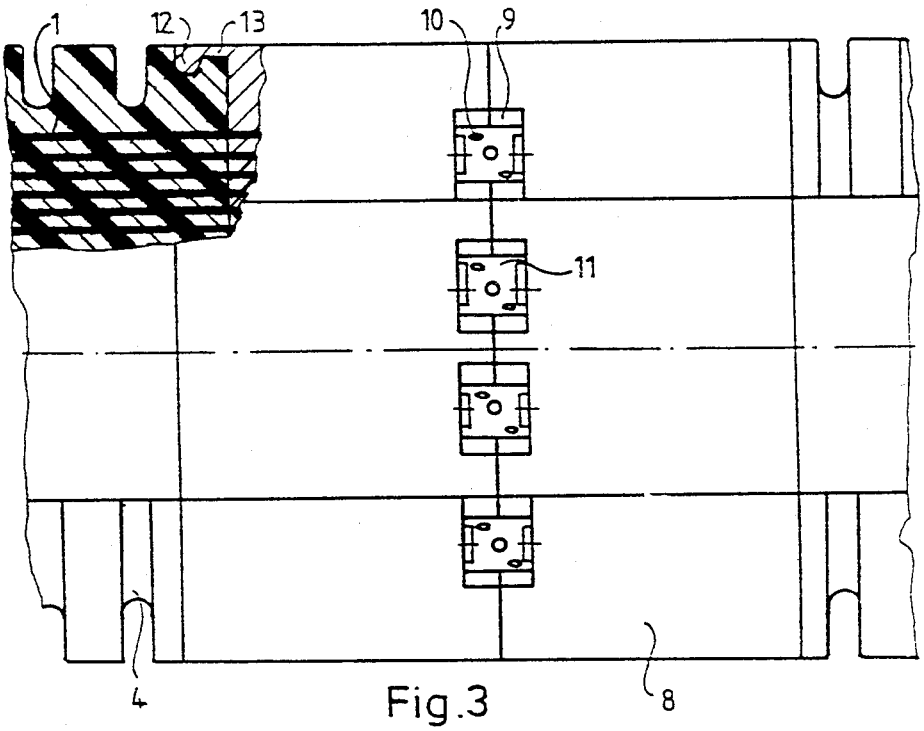
FIG. 3; view of a jointing element shown partly in section.
Figure 4:
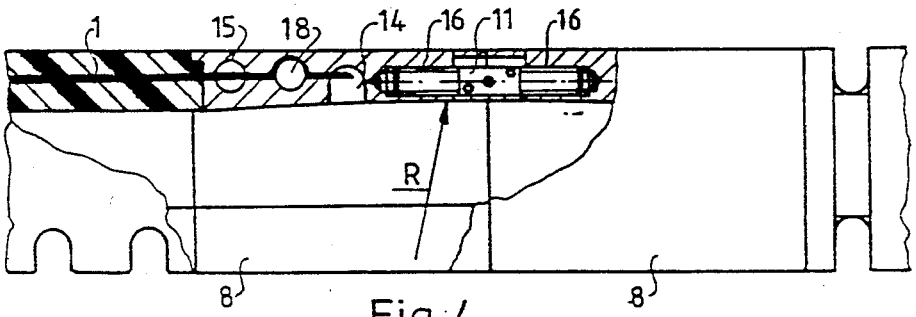
FIG. 4; another view of the joint according to FIG. 3, partly in section.

FIG. 3 and 4 show the top and side view of an example for such mechanical jointing method.

An end 13 of the injection moulded polyurethane hand-rail is connected to a flange 12 of a metal joint 8.

The metal joints 8 are fixed to each other with right and left threaded screws 11 inserted into threaded holes 16. The middle part of the screws 11 may be hexagonal, for tightening with fork spanner, or cylindrical, screwed in the tightened through holes 10 with steel manderl. The screws 11 are accessible through millings 9 as shown in FIG. 3.

The metal joints 8 are connected with the ends of the polyurethane hand-rail through fixing the ends of the steel wire 1. The steelwires 1 are threaded through the split holes of the metal joints. They are fixed with lock pins 18 knocked into the retaining holes 15 perpendicular to the split holes, so that by knocking in the lock pins 18, the steel wires are bent up and jammed between the retaining holes 15 and the lock pins.

The ends of the steel wires can be threaded into the metal joints in the required length. This is realizable by millings in the form of openings 14, as shown in FIG. 4.

This solution allows that using the above metal joints the hand-rails be prefabricated in an assortment with lengths prescribed in accordance with actual demands. The dimensions of the lengths are selected as to obtain any desired length by connecting one or several pieces with the built-in jointing elements on the site.

The blind splicing of the polyurethane foam hand-rails with mechanical joint does not exclude the applicability of other splicing methods. Thus, for example the escalator hand-rails can be spliced with foaming on the site of assembly. In case of this solution, the polyurethane cover is stripped from the reinforcing steel wire along a certain length at the ends of the hand-rail, then overlapping the ends of the steel wire, incidentally mechanically jointing the overlapped ends of the steel wire, then it is placed into a splicing tool and foamed together with injection moulding of polyurethane foam.

Since the hand-rail does not include textile inserts, in the case of this splicing method lower shear stresses arise, and thus, the splicing is considerably more durable than that of the traditional vulcanized rubber hand-rails.

Figure 5:
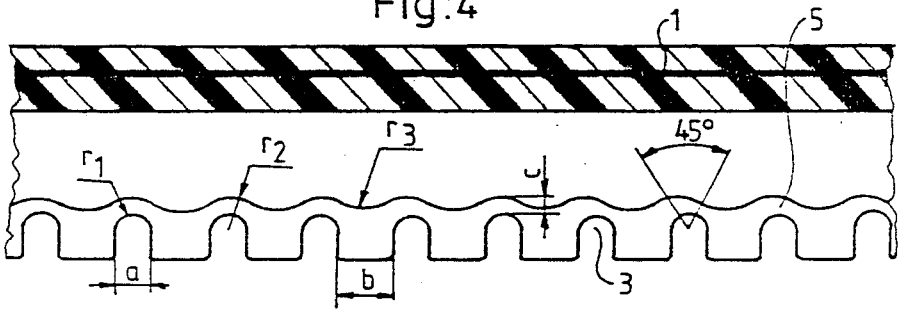
FIG. 5; longitudinal section of the hand-rail according to the invention.

The structure of the lamellated surface is shown in detail in FIG. 5. The lamellated surface is formed by indentations 3 between projections. The distance between two indentations 3 is "b", and the width of the indentations 3 is "a". Said distance b between the indentations, i.e. the width of said projections is always greater than the width of said indentations 3. The bottom of said indentations 3 has a profile of a segmental circle if shown in section. The circle itself is defined by a radius $r_1$. The embodiment of FIG. 5 has a lamellated outer surface while the inner surface opposite the lamellated outer surface is provided with concave and convex arches. Opposite each indentation 3 a convex arch is formed, which has a profile of a segmental circle defined by a radius $r_2$. Circles defined by radii $r_1$ and $r_2$ are concentric. Between indentations 3 projections are obtained on the outer surface of the side on the inner surface of the side part of the "C"-shaped hand-rail there are concave arches contoured by a segmental circle if shown in section. This circle is defined by radius $r_3$.

Indentations 3 and opposite these indentations or recesses 3 arches 5 (bridges) are formed in the fashion, as shown, such that above each recess 3 there is a wave crest and between adjoining recesses, there is a wave through. The thickness c of an arch 5 is smaller than the width of a indentation 3. Radii $r_2$ and $r_3$ are associated with wave crests and troughs, respectively. Radii $r_1$ and $r_2$ are concentric and their circles intersect each other at an angle of minimum 45°. Also as can be seen in FIG. 5, the relationship $c<a$ holds, whereby the hand-rail is more flexible.

Figure 6:
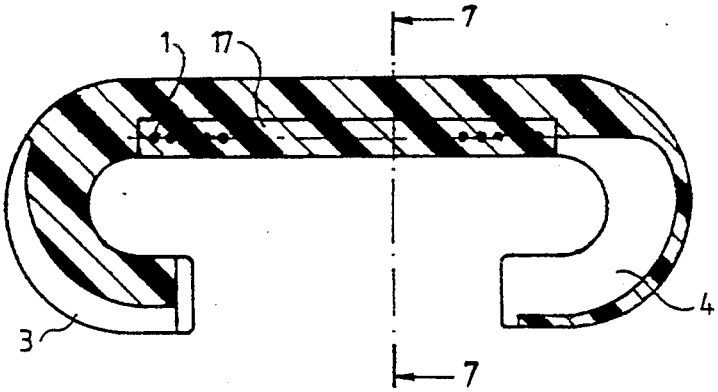
FIG. 6; an embodiment of the invention laminated both on inner and outer surface of the side part of the hand-rail.

FIG. 6 shows an embodiment of the invented hand-rail wherein both the inner and outer surface of the side part are lamellated, i.e. the inner surface is provided with inner indentations 4 and the outer surface is provided with outer indentations 3. Indentations 3 and 4 extend up to the plain of steel wire insert 2 embedded in strap 17.

Figure 7:
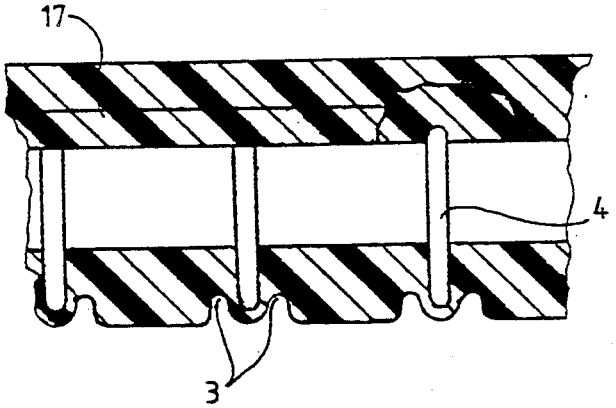
FIG. 7; sectional view of the embodiment of FIG. 6.

FIG. 7 shows a section of this embodiment taken along line A—A of FIG. 6.

FIG. 7 indicates that outer indentations 3 are formed symmetrically to inner indentations 4, on both side of an inner indentation 4 is a respective outer indentation 3, i.e. along the hand-rail each inner indentation 4 is followed by two outer indentations 3. Between two consecutive inner indentations 4 there are two outer indentations 3 on the opposite surface.

However, the invented hand-rail may be constructed with indentations arranged simply alternatively on the outer and inner surface thereof.

The sliding surface of the invented hand-rail can be provided with a metal or synthetic insert in order to reduce friction between the hand-rail and the rail guiding it or to reduce abrasion.

We claim:

1. Reinforced "C" profiled moving hand-rail made of elastic material particularly for use with escalators, moving pavement and the like, said hand-rail comprising side portions having inner and outer surfaces, said hand-rail is injection moulded from polyurethane, foamed polyurethane or a synthetic material possessing similar physical characteristics so that at least one of the inner and outer surface of side parts of the hand-rail is lamellated, the other one of said inner and outer surface opposite the lamellated surface is wave-shaped and the hand-rail in a neutral or stress free zone generally at a central part of the hand-rail is provided with reinforcing steel wire insert extending in the longitudinal direction, wherein said inner surface is formed by a plurality of indentations having an open outer and a closed inner end, and being made in said surface transversely with respect to the longitudinal direction of said hand-rail and formed in a series sequence along said longitudinal direction with a predetermined distance between adjacent indentations, wherein opposite said inner ends of said indentations said lamellated surface forming wave crests and between adjoining indentations said lamellated surface forming wave troughs.

2. Hand-rail as claimed in claim 1, characterized in that each end of said hand-rail is provided with a releasable metal joint fixed to the reinforcing steel wire insert, for forming an endless belt.

3. Hand-rail as claimed in claim 1, characterized in that the steel wire insert is embedded in a strap extending in said neutral zone of the "C" profile along the length of the hand-rail and said strap is made of polyurethane or other synthetic material.

4. Hand-rail as claimed in claim 1, wherein said indentations at their said inner ends comprise an arched bottom with a profile of a segmental circle of a first radius ($r_1$), and wherein opposite to said bottom of each indentation, on the lamellated surface a convex arch is formed, said convex arch is defined by a segmental circle of a second radius ($r_2$), and wherein between adjacent convex arches concave arches are formed, said concave arches are defined by a segmental circle of a third radius ($r_3$), the circles having the first radius and second radius are concentric.

5. Hand-rail as claimed in claim 4, wherein lines passing from the centers through tangential points of said segmental circles with said second radius ($r_2$) and of said segmented circles with said third radius ($r_3$) form an angle of minimum 45°.

6. Hand-rail as claimed in claim 4, wherein said indentations have a width (a) and adjacent indentations are spaced at a distance (b), the distance (b) between said indentations is wider than the width (a) of said indentations, and the width (a) of said indentations exceeeds the difference between radii ($r_2-r_1$) of said first and second concentric circles.

7. Hand-rail as claimed in claim 1, characterized in that the hardness of said elastic material is between 80° and 95° Sh.

* * * * *

UNITED STATES PATENT AND TRADEMARK OFFICE

CERTIFICATE OF CORRECTION

PATENT NO. : 4,852,713

DATED : August 1, 1989

INVENTOR(S) : TATAI , et al

It is certified that error appears in the above-identified patent and that said Letters Patent is hereby corrected as shown below:

On the title page:

(75) Inventors: Ilona Tatai; Gusztav Gundisch; Laszlo Palotas; Gyula Subotics, all of Budapest, Hungary

Signed and Sealed this

Fourteenth Day of August, 1990

*Attest:*

HARRY F. MANBECK, JR.

*Attesting Officer*

*Commissioner of Patents and Trademarks*